US005119991A

United States Patent [19]

Divers

[11] Patent Number: 5,119,991

[45] Date of Patent: Jun. 9, 1992

[54] SELF-CLEANING NOZZLE AND ASSOCIATED METHOD

[75] Inventor: Edward F. Divers, Pittsburgh, Pa.

[73] Assignee: Robert O. Agbede, Monroeville, Pa.

[21] Appl. No.: 596,868

[22] Filed: Oct. 12, 1990

[51] Int. Cl.[5] ..... B05B 15/02

[52] U.S. Cl. ..... 239/117; 239/106; 239/123; 239/456

[58] Field of Search ..... 239/115, 116, 117, 106, 239/114, 118, 123, 452, 459, 456; 222/149

[56] References Cited

U.S. PATENT DOCUMENTS

| | | | |
|---|---|---|---|
| 713,852 | 11/1902 | Chapin | 239/117 |
| 1,005,640 | 10/1911 | Gardner | 239/117 |
| 1,364,566 | 1/1921 | Logan | 222/149 |
| 1,778,291 | 10/1930 | Burke | 222/149 |
| 2,117,647 | 5/1938 | Boehm | 299/59 |
| 2,569,081 | 9/1951 | Veach | 239/487 |
| 2,652,857 | 9/1953 | Engstrum | 137/701 |
| 2,803,499 | 8/1957 | Goyette et al. | 239/118 |
| 3,017,120 | 1/1962 | Friant et al. | 239/117 |
| 3,059,857 | 10/1962 | Friant et al. | 239/117 |
| 3,474,968 | 10/1969 | Jackson | 239/118 |
| 3,612,409 | 10/1971 | Henning | 239/601 |
| 3,745,945 | 7/1973 | Wilson | 222/149 |
| 4,223,838 | 9/1980 | Maria-Vittorio-Torrisi | 239/109 |
| 4,396,044 | 8/1983 | Ahlers | 141/90 |
| 4,480,789 | 11/1984 | Kemper | 239/116 |
| 4,629,120 | 12/1986 | Diamond | 239/117 |

FOREIGN PATENT DOCUMENTS

| | | | |
|---|---|---|---|
| 0654306 | 4/1979 | U.S.S.R. | 239/106 |
| 0803989 | 2/1981 | U.S.S.R. | 239/123 |

OTHER PUBLICATIONS

"Nonclogging Water Spray System for Continuous--Mining Machines: Installation and Operating Guidelines", U.S. Dept. of Interior, Bureau of Mines Info. Cir/1976, IC 8727, pp. 1-10.

Guidelines for choosing face ventilation systems, Messrs. Divers & Volkwein, Oct. 1987, pp. 46-47 & cont. on p. 59.

*Primary Examiner*—Andres Kashnikow
*Assistant Examiner*—Christopher G. Trainor
*Attorney, Agent, or Firm*—John M. Adams

[57] ABSTRACT

A nozzle assembly includes a sleeve, a nozzle having an interior opening and slidable within the sleeve and a plunger that enters the interior opening of the nozzle. When the nozzle is slid within the sleeve, the plunger coacts with the nozzle to clean any foreign substances present within the nozzle and remove a clog in the nozzle.

20 Claims, 3 Drawing Sheets

SELF-CLEANING NOZZLE AND ASSOCIATED METHOD

BACKGROUND OF THE INVENTION

1. Field of the Invention

This invention relates to nozzles that are employed to spray fluids such as water that may contain nozzle clogging foreign substances and, more particularly, to a nozzle which is capable of self-cleaning such foreign substances.

2. Description of the Prior Art

Nozzles for spraying fluids are well known in the art and are frequently employed to provide a controlled spray pattern of liquids such as water. In most uses, nozzles may function for extended periods of time without maintenance since the fluid sprayed by the nozzles does not contain any foreign substances that cause adverse effects such as clogging of the nozzle. However, in some applications, nozzles may have a tendency to become clogged because contaminants that may be suspended in the fluid to be conducted by the nozzle may clog the fluid passageway in the nozzle. Such nozzle clogging is, of course, undesirable since the clogged nozzle must be cleaned before it is again in effective condition for its intended use.

Coal mines frequently have dust suspended within the air in the mine. Such dust is undesirable because it can create a health hazard to personnel within the mine that breaths the dust. Additionally, such dust may have an adverse effect on the operation of equipment within the mine. Such dust, however, is frequently difficult to remove from the air.

One such way to control dust within a coal mine is by spraying water through the air that contains the dust since a substantial amount of the dust will mix with the water and settle to the floor of the mine with the water. Spray systems are very effective in preventing dust from becoming airborne in a coal mine. The degree of effectiveness of the spray is dependent on the rate of flow of the water and the coverage, or area, over which the water is sprayed rather than the pressure of the water itself. Water sprays may also be effective in pushing or drawing airborne dust away from the area where personnel are working.

It has been experimentally determined that the most effective spray systems reduce inhalable size dust by about 60%. When such spray systems are used in conjunction with proper ventilation systems, almost complete elimination of airborne dust from the vicinity where personnel are working can be achieved.

Water spraying nozzles are frequently employed to spray water to control the dust. However, such nozzles tend to become clogged by airborne contaminants and contaminants entrained in the spray water. Studies have determined that most contaminants come from the water employed to produce the spray. Most contaminants are in the form of coal, although pipe scale, sand and some stone may also be present. Also, studies have shown that about ⅓ to ⅔ of water spray systems may be clogged at any given time within a coal mine and that each system may become repeatedly clogged during a single work shift. Further, previous solutions to such clogging conditions required either a lengthy cleaning process or replacement of part of the spray system itself. Both solutions resulted in considerable system downtime. Therefore, a need exists for a water spray nozzle that can be quickly and effectively unclogged should such clogging occur.

Several methods have been generally employed to control clogging of water spray systems. One method is to remove foreign substances or contaminants from the water prior to their introduction into a water nozzle. A second method is to bypass the foreign material away from the spray nozzle prior to entry therein, while, a third method is to employ nozzles having configurations that reduce clogging even if contaminants, either airborne or water entrained, should reach the nozzle.

Effective but expensive systems have been developed to remove particles from water. One system, developed by the U.S. Bureau of Mines and described in "Bureau of Mines Information Circular IC 8727", 1976, employs an inline Y-strainer that acts as a coarse strainer to remove large particles greater than about ⅛" in size, a hydrocyclone-type separator to remove and store almost all particles less than ⅛" in size and, finally, a particle filter to remove fine particles. That system virtually prevents clogging when maintained in proper operating condition. However, a drawback is that the cost of that system is relatively expensive.

The second, bypass method of controlling clogging employs a large spray manifold in the fluid path, just before the water reaches the nozzle. The manifold provides a container where particulates can settle just before they reach the nozzle. Occasional flushing of the manifold is necessary to remove accumulated, collected foreign material. This system is less costly than the above-mentioned filtration system and can be reasonably effective.

The third method of controlling clogging under circumstances where particles are not removed from the water prior to reaching the spray nozzle is based on the fact that the nozzle clogging is inversely proportional to the size of the orifice through the nozzle. Also nozzles that allow water to enter the nozzle at an angle, or tangentially to the direction of water flow through the nozzle, just upstream of the nozzle orifice clog less frequently than those wherein the water enters generally co-linearly with the flow of the water through the nozzle. The tangential entry port imports a cyclone-type internal flow within the nozzle that helps to reduce clogging. Thus, the third method employs large water discharge ports and tangential water entry ports, both of which tend to reduce clogging.

Despite the effectiveness of these three methods of controlling nozzle clogging, the nozzles employed with these systems may still clog and under certain circumstances, such systems may not be adequately effective. Therefore, a simple and effective device is necessary to quickly alleviate clogged nozzle conditions when such clogging occurs.

A variety of water nozzles have been proposed, such as disclosed in U.S. Pat. No. 2,117,647 in which a jet cleaning device is shown for a nozzle having an axially displaceable plunger movable into the nozzle by the application of a force on the plunger. The force on the plunger opposes a biasing force applied by a spring that is interposed between the nozzle and the plunger. Cleaning of the nozzle is accomplished by first pushing the plunger into the nozzle and then rotating the plunger. Release of the force applied against the plunger causes the plunger to be withdrawn from the nozzle due to the biasing force of the spring. A disadvantage of this device is that cleaning involves a twostep process of pushing the plunger within the nozzle and then rotating the plunger within the nozzle.

U.S. Pat. No. 2,652,857 discloses a valve for dispensing volatile substances such as resins, waxes and paints. The valve is opened by depressing a button against the biasing force of a spring to retract a valve member from a nozzle to allow fluid to flow through the valve and nozzle. Successive operation of the button moves the valve member into and out of the nozzle to generate a cleaning action of the sidewalls of the nozzle. This device has the disadvantage that cleaning action occurs only through successive movement of the valve member into and out of the nozzle.

U.S. Pat. No. 3,059,857 discloses a windshield washer system. One embodiment of the system includes a housing with an orifice through which an axially displaceable nozzle projects to discharge windshield washer solution. The nozzle is axially advanced through the orifice by the pressure of windshield washer fluid against the nozzle. Such advancement clears foreign substances that may be positioned within the orifice, however, such nozzle advancement cleans only foreign substances in the orifice but not foreign substances that may be present within the nozzle itself.

In a second embodiment of the invention, shown in U.S. Pat. No. 3,059,857, the housing supports a needle valve and a nozzle. The needle valve projects within an orifice of the nozzle when the nozzle is closed and no washer fluid is being dispensed thereby sealing the nozzle. When windshield washer solution is directed to the nozzle, the nozzle is axially advanced away from the needle valve thereby allowing discharge of the solution through and from the nozzle. Removal of the washer solution pressure from the nozzle causes the nozzle to be returned to a sealing position by a force applied by a biasing spring connected to the nozzle wherein the needle valve again seals the nozzle by projecting through the nozzle orifice. Return of the nozzle to the sealing position, thereby causing the needle valve to be projected through the nozzle, cleans foreign substances from the orifice of the nozzle. The washer solution discharge end of the nozzle is sealed from the housing by a flexible membrane extended between the movable nozzle end and the housing.

This embodiment shown in the above patent has the disadvantage that the membrane is flexed, or bent, each time the nozzle is axially advanced or returned due to relative movement between the nozzle and housing. Such regular bending may lead to early failure of the membrane due to fatigue. Further, such membranes may be susceptible to deterioration due to chemical exposure from the ambient atmosphere.

In a third embodiment of the invention shown in U.S. Pat. No. 3,059,857, the membrane between the housing and the nozzle is eliminated and scraping elements are attached to the nozzle to clean the interior of the housing as the nozzle is advanced from and returned toward the housing. These elements do not, however, clean the interior of the nozzle itself. Overall, with each of the above described embodiments the cleaning action occurs only when a change in fluid pressure within the housing causes the nozzle to move. Consequently, a disruption to the flow of fluid from the nozzle due to the changes in fluid pressure may occur during cleaning.

U.S. Pat. No. 3,474,968 discloses a self-cleaning nozzle that is axially movable into and out of the housing supporting the nozzle. The pressure of the fluid that is discharged from the nozzle controls the movement of the nozzle into and out of the housing. The nozzle is a generally hollow, cylindrical body having a sidewall defining one or more slits. The fluid to be discharged from the nozzle enters the nozzle through the slits and exits through an open end of the nozzle. A spider member, having projections that extend into the slits of the nozzle, is attached to the housing so as the nozzle moves into and out of the housing, any foreign substances that may be caught within the slits of the nozzle will be cleared.

A disadvantage with the device shown in U.S. Pat. No. 3,474,968 is that nothing is provided to clear the interior of the nozzle itself should a foreign substance pass through the slits and into the nozzle since the only cleaning action is provided by the slits in the side of the nozzle. Further, cleaning takes place only when a change in fluid pressure in the housing causes the nozzle to move. Again, a disruption to the fluid flow from the nozzle may occur as the result of changing fluid pressure during cleaning.

U.S. Pat. No. 4,223,838 discloses a self-flushing flow emitter for a drip irrigation system. The emitter includes a nozzle assembly having a nozzle and an axially displaceable rod which moves within the fluid discharge port of the nozzle in response to fluid pressure within the port. An increase in the fluid pressure causes the rod to advance further into the port while a decrease in pressure causes the rod to retract from the port under the influence of the force of a biasing spring. The advancement and retraction of the rod into and out of the port serves to clean the port. A disadvantage of this device is that cleaning takes place only when a change in fluid pressure in the housing causes the nozzle to move. Again, a disruption to the fluid flow from the nozzle may occur as the result of changing fluid pressure during cleaning.

U.S. Pat. No. 4,396,044 discloses a rinsing apparatus for cleaning filling elements of a filling machine. A filling element includes an axially displaceable rod that acts as a valve to open and close the filling element. The rod protrudes from the fluid discharge end of the filling element by an amount equal to the displacement of the valve between its open and closed position. Axial movement of the rod into the interior of the filling element causes the valve to open and allow fluid to be discharged from the fluid discharge port. The filling element is cleaned by opening the valve and introducing steam into the filling element.

U.S. Pat. No. 4,480,789 discloses a water nozzle for dust suppression. The device includes a water nozzle housing with an axially displaceable rod and piston assembly that is movable in one direction under the influence of water pressure within the nozzle and in the opposite direction under the influence of a biasing spring. Axial movement of the piston acts to clean a portion of the nozzle. However, even when the rod and piston assembly is advanced by the water pressure, the piston does not extend fully into the nozzle. Therefore, the entire extent of the nozzle is not cleaned by the rod and piston action. Further, movement of the piston is in response to variations in water pressure within the nozzle, thus, cleaning takes place only when a change in fluid pressure in the housing causes the nozzle to move. Again, a disruption to the fluid flow from the nozzle may occur as the result of changing fluid pressure during cleaning.

U.S. Pat. No. 4,629,120 discloses a self-cleaning atomizer nozzle assembly. The nozzle assembly includes a rod that extends through a fluid discharge port of a nozzle when the nozzle is axially displaced towards the rod by an axial force applied to a knob that is connected to the nozzle. The device is primarily adapted for the permanent mounting in the wall of a shower and has the disadvantage that the same knob that is employed for axially moving the nozzle relative to the rod for cleaning also is employed for adjusting the spray pattern of the nozzle through rotation of the knob. Therefore, it is possible that the control may be inadvertently rotated, thereby affected the spray pattern of the nozzle, even though the only intention was to momentarily axially advance the nozzle for cleaning only.

While a number of solutions have been proposed for cleaning a nozzle of particulate matter that becomes lodged in the outlet of the nozzle, the known device requires a change in the fluid pressure in the nozzle housing to move the nozzle. A disruption of the fluid flow through the nozzle is required to generate a fluid pressure differential. Therefore, there is a need to provide a self-cleaning nozzle that facilitates removing particulate matter clogging the nozzle without disrupting operation of the nozzle to generate the desired spray.

SUMMARY OF THE INVENTION

In accordance with the present invention, there is provided a self-cleaning nozzle assembly for conducting a fluid that includes a sleeve having at least one fluid entry port for receiving the fluid. The sleeve defines a cavity for receiving the fluid from the fluid entry port. The sleeve has an extreme end displaced from the fluid entry port. A nozzle has a body portion supported by the sleeve. The nozzle body portion has an opening therethrough and an exterior surface. The nozzle is slidable between a retracted position and an extended position within the sleeve cavity. The nozzle has an exterior surface held by and in slidable engagement with the extreme end of the sleeve. The nozzle opening receives fluid from the sleeve cavity and conducts the fluid out of the nozzle body portion. A plunger is supported by the sleeve. The plunger has a body portion axially aligned with the nozzle body portion. The nozzle body portion is movable relative to the plunger body portion to position the plunger within the nozzle body portion opening when the nozzle is slid in a direction from the extended position toward the retracted position to clean the nozzle.

Further, in accordance with the present invention, there is provided a method for cleaning a nozzle that comprises the steps of conducting fluid to a nozzle sleeve. A nozzle is slid in sliding engagement with an extreme end of the nozzle sleeve toward an extended position relative to the nozzle sleeve. Fluid is transferred from the nozzle sleeve to the nozzle. Fluid is conducted away from the nozzle. The nozzle is slid in sliding engagement with the extreme end of the nozzle sleeve toward a retracted position relative to the sleeve to axially align and position a plunger within the nozzle to clean the nozzle.

An additional feature of the present invention is directed to a self-cleaning nozzle assembly for conducting a fluid that includes a sleeve having a fluid entry port at an end of the sleeve. The fluid entry port receives the fluid. The sleeve defines a cavity for receiving the fluid from the fluid entry port. A nozzle has a body portion supported by the sleeve. The nozzle body portion has an opening therethrough. The nozzle is movable between a retracted position and an extended position within the sleeve cavity. The nozzle opening receives the fluid from the sleeve cavity and conducts the fluid out of the nozzle body portion. A plunger is supported by the sleeve and has a body portion. The nozzle body portion is movable relative to the plunger body portion to position the plunger within the nozzle body portion opening when the nozzle is moved in a direction from the extended position toward the retracted position to clean the nozzle. The fluid entry port includes an oblique circular cylinder for creating a pattern of flow of the fluid conducted out of the nozzle body portion.

A principal object of the present invention to provide a self-cleaning fluid nozzle assembly to effectively spray water or other fluids in environments that may contain nozzle clogging foreign substances, such as dust, and that may be self-cleaned of such foreign substances with minimal disruption to the fluid spray process.

A further object of the present invention is to provide a self-cleaning fluid nozzle assembly having a plunger that enters the fluid conducting passageway to self-clean the foreign substances that may tend to clog the nozzle.

An additional object of the present invention is to provide a self-cleaning fluid nozzle assembly that is slidably mounted in a sleeve that supports the cleaning plunger so that cleaning action of the nozzle is accomplished by sliding the nozzle relative to the sleeve to insert the plunger within the fluid conducting passageway of the nozzle.

Another object of the present invention is to provide a self-cleaning fluid nozzle assembly that employs a fluid entry port having an oblique circular cylinder for creating a wide spray pattern of fluid from the nozzle.

A further object of the present invention is to provide a method for cleaning a nozzle by slidably positioning a nozzle within a sleeve that supports a plunger so that the nozzle is slid relative to the sleeve to insert the plunger into the nozzle to clean the nozzle.

These and other objects of the present invention will be more completely disclosed and described in the following specification accompanying drawings and appended claims.

DESCRIPTION OF THE PREFERRED EMBODIMENTS

Figure 3:
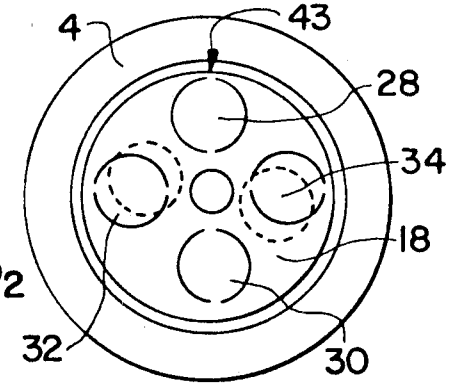
FIG. 3 is an elevational view of the nozzle assembly shown in FIG. 1 taken along line III—III of FIG. 1.
Figure 1:
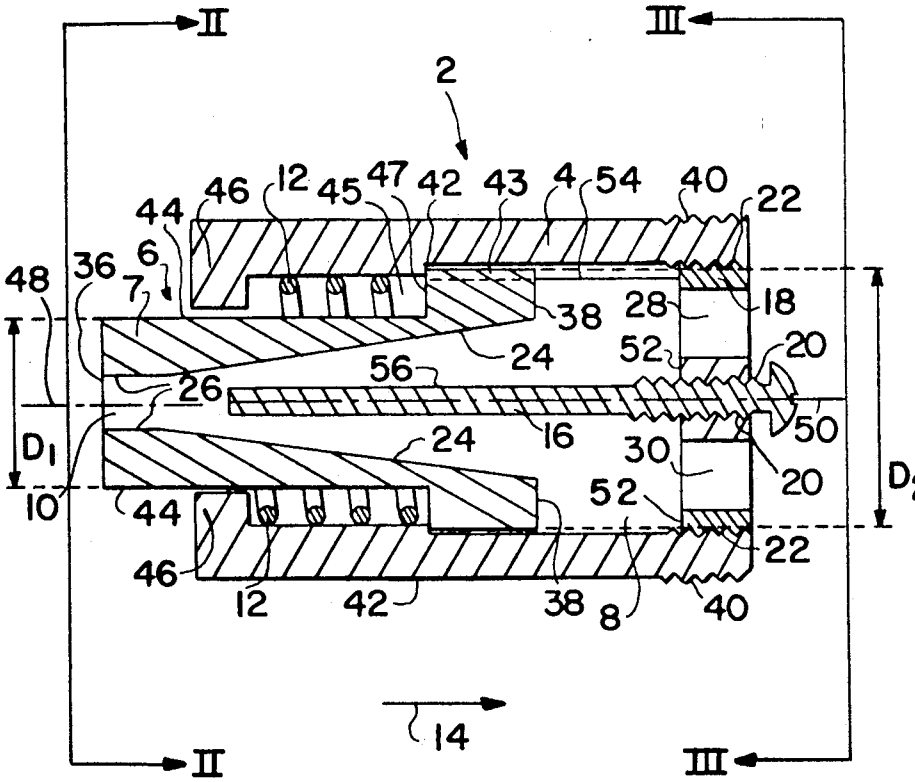
FIG. 1 is a side elevational view in section of one embodiment of a nozzle assembly of the present invention.
Figure 2:
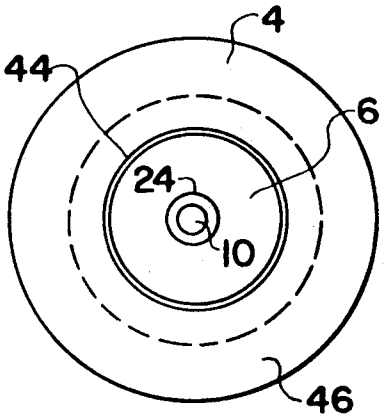
FIG. 2 is an elevational view of the nozzle assembly shown in FIG. 1 taken along line II—II of FIG. 1.

Referring to FIGS. 1-3 there is illustrated one embodiment of a nozzle assembly 2 of the present invention that includes a sleeve 4 and a nozzle 6 having a nozzle body portion 7. Sleeve 4 defines an interior cavity 8 for receiving the water or other fluid that is to be discharged through an interior opening 10 of nozzle 6. As spring 12 positioned within the sleeve 4 and surrounding nozzle body portion 7 biases nozzle 6 toward a retracted position in the direction of arrow 14.

Plunger 16 is supported in sleeve end 18 by cooperating threads 20, that allow plunger 16 to be moved in the direction of and opposite the direction of arrow 14 by rotating plunger 16 relative to sleeve end 18. Sleeve end 18 is supported by sleeve 4 through cooperating threads 22. Threads 22 allow sleeve end 18 to be moved in the direction of and opposite the direction of arrow 14 through the rotation of sleeve end 18 relative to sleeve 4.

Nozzle body portion 7 includes sidewall 24 that further defines a partially tapered, or partially conical, portion of interior opening 10. Sidewall 26 of nozzle body portion 7, includes a generally cylindrical portion of interior opening 10.

Inlet ports 28, 30, 32 and 34, as shown in FIG. 3, provide an opening for receiving water or other fluid into interior cavity 8 of sleeve 4. The inlet ports may include an interior opening that is generally a right circular cylinder, as defined by inlet ports 28 and 30, or may take on another configuration, such as an obtuse circular cylinder as defined by inlet ports 32 and 34.

The obtuse circular cylinder configuration of ports 32 and 34 direct fluid flow in either a clockwise or counterclockwise direction relative to sleeve end 18. The obtuse circular cylinder configuration of inlet ports 32 and 34 assists in providing a wide spray discharge pattern form exit port 36 of nozzle 6, irrespective of whether the flow is clockwise or counterclockwise. Also, water entering cavity 8 through inlet ports 32 and 34 enters tangentially to, rather than co-linearly with, the flow of water through nozzle 6. Such tangential water entry imparts a cyclone-type internal water flow within nozzle assembly 2 that reduces nozzle clogging. Contrastingly, right circular cylinder ports 28 and 30 tend to produce a more narrow spray discharge pattern from exit port 36 and may not reduce a tendency toward nozzle clogging as do ports 32 and 34.

By providing a plurality fluid inlet ports 28, 30, 32 and 34, rather than just a single fluid inlet port, the total fluid entry passageway area may be divided up into several ports each with a smaller cross-sectional area than one large port. The smaller cross-sectional area of each of the smaller ports helps to restrict the passage of foreign substances, that may cause clogging, into interior cavity 8.

Fluid within interior cavity 8 applies a fluid pressure against surface 38 of nozzle body portion 7. The fluid pressure is converted to a force against surface 38 that opposes the biasing force of spring 12. If the force against surface 38 is of a magnitude sufficient to overcome the biasing force of spring 12, nozzle 6 then slides in a direction opposite arrow 14 within sleeve 4. This sliding movement occurs with surface 44 of nozzle body portion 7 in sliding engagement with extreme end 46 of sleeve 4.

Threads 40 are externally positioned on sleeve 4 for attachment of nozzle assembly 2 to a fluid conduit (not shown) such as a hose, that supplies the water or other fluid to nozzle assembly 2. Stop 42 formed by a shoulder on sleeve 4 limits the linear travel of nozzle 6 in the direction opposite arrow 14. Surface 44 of nozzle body portion 7 is tightly sealed to extreme end 46 of sleeve 4 to resist fluid flow therebetween so that virtually all fluid flow out of nozzle assembly 2 occurs through exit port 36 of nozzle 6. Nozzle 6 includes longitudinal axis 48 that is generally parallel to an axis 50 of plunger 16.

As shown in FIG. 1, nozzle 6 is in an extended position relative to sleeve 4. Nozzle 6 is slid in the direction of arrow 14 toward a retracted position wherein surface 38 of nozzle body portion 7 moves toward surface 52 of sleeve end 18. This sliding movement in the direction of arrow 14 may occur as the result of biasing by spring 12, by another force applied in the direction of arrow 14 against nozzle body portion 7, or by a combination of both.

When nozzle 6 is moved from its extended position toward its retracted position, plunger 16 further enters interior opening 10 of nozzle body portion 7 thereby dislodging any foreign substances, or contaminants, that may be present therein and which may clog nozzle 6.

Plunger 16 and interior opening 10 are each contoured to cooperate to form a desired spray pattern of the fluid discharged from exit port 36. The spray pattern is also a function of the relative positioning between nozzle 10 and plunger 16. For example, a longer and more tapered contour of plunger 16 produces a longer and more tapered spray pattern than a shorter and less tapered contour of plunger 16. Further, a longer and more tapered spray pattern is produced if plunger 16 is positioned farther within nozzle body portion 7 than if positioned farther away from nozzle body portion 7.

In operation, sleeve end 18 is rotated on threads 22 so that the desired distance of travel 54 of nozzle body portion 7 occurs as nozzle 6 is moved between its extended and retracted positions. This adjustment of sleeve end 18 provides a desired amount of compressive force, or preload, by spring 12 on nozzle 6 when surface 38 of nozzle body portion 7 is in contact with surface 52 of sleeve end 18. Plunger 16 is rotated on threads 20 to relatively position it with respect to nozzle body portion 7 so that a desired spray discharge pattern of fluid occurs from exit 36 when nozzle 6 is in its extended position, as shown in FIG. 1. Sidewall 24 assists in the guidance of plunger 16 within interior opening 10.

Nozzle assembly 2 is connected to a source of water, or other fluid (not shown), preferably, by connecting the source of fluid to threads 40. The fluid supplied to interior cavity 8 may be provided through inlet ports 28, 30, 32 and 34. The pressure of the fluid is applied to surface 38 of nozzle body portion 7 thereby causing a force to be applied to nozzle body portion 7 in a direction opposite arrow 14 that opposes the biasing of spring 12. If the pressure of the fluid is sufficiently large, nozzle 6, then moves at least partially from its retracted position (not shown) wherein surface 38 is in contact with surface 52 toward its extended position. If the fluid pressure within interior cavity 8 is of a sufficient magnitude, then nozzle 6 is fully slid to its extended position against stop 42 as shown in FIG. 1. The fluid then proceeds from interior cavity 8 into interior opening 10 and is discharged through exit port 36. Stop or shoulder 42 limits the distance of travel of nozzle 6 toward its extended position thereby decreasing the likelihood of failure of spring 12 due to fatigue.

A passageway 43 provided in nozzle body portion 7 extends from interior cavity 8, at surface 38, to opening 45 between sleeve 4 and nozzle body portion 7. As fluid under pressure enters interior cavity 8, some of the fluid is directed from interior cavity 8, through passageway 43 and into opening 45. This fluid flow exerts substantially the same pressure against surface 47 as is exerted by the fluid against surface 38 if a tight seal exists between surface 44 and extreme end 46. The fluid pressure applied to surface 47 creates a force on surface 47 in a direction opposite arrow 14. Thus, the fluid force against surface 47 partially balances the fluid force against surface 38. The ratio of the force applied to surface 47 to the force applied to surface 38 is proportional to the ratio of the area of the surface 47 to the area of the surface 38, shown in FIG. 1. The appropriate selection of $D_1$ and dimension $D_2$ helps to determine the fluid pressure at which nozzle 6 moves between its extended and retracted positions. For example, reducing the value of dimension $D_1$ tends to balance fluid forces on nozzle body portion 7, which is useful in high pressure fluid systems.

If nozzle assembly 2 is used in an environment where foreign substances may contaminate the fluid flowing through nozzle assembly 2, such as in a coal mine, nozzle 6 may become clogged during the fluid flow process. In that case, a force may be applied to nozzle 6 to slide it in the direction of arrow 14 relative to sleeve 4. Plunger 16 is then positioned within interior opening 10 of nozzle body portion 7 thereby clearing or cleaning any foreign particles which may be clogging interior opening 10.

In one embodiment, the relative dimensions of exterior surface 56 of plunger 16 and side wall 26 of nozzle body portion 7 are such that when nozzle 6 is moved to its retracted position, surface 56 of plunger 16 is sealed against sidewall 26 of nozzle body portion 7 so that little or no fluid may pass to exit port 36. This is advantageous if it is desirable to seal exit port 36 from ambient foreign substances that may have the potential to enter and clog exit port 36.

Alternatively, in another embodiment exterior surface 56 has a dimension forming a gap or passageway between exterior surface 56 and sidewall 26 when nozzle 6 is in its retracted position allowing fluid flow therebetween. This is advantageous for allowing fluid flow from exit port 36 even when nozzle 6 is retracted during cleaning of interior opening 10. With both of the above described arrangements, once the clogged condition of nozzle 6 has been overcome, nozzle 6 is then released to allow the fluid pressure within interior cavity 8 to again overcome the biasing force of spring 12 and pressure within opening 45 to allow nozzle 6 to assume its extended position. This nozzle cleaning process is performed repeatedly as necessary to clean, or clear nozzle 6 of foreign particles.

Figure 6:
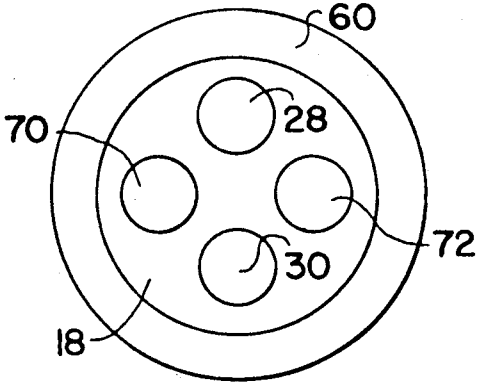
FIG. 6 is an elevational view of the nozzle assembly shown in FIG. 4 taken along line VI—VI of FIG. 4.
Figure 4:
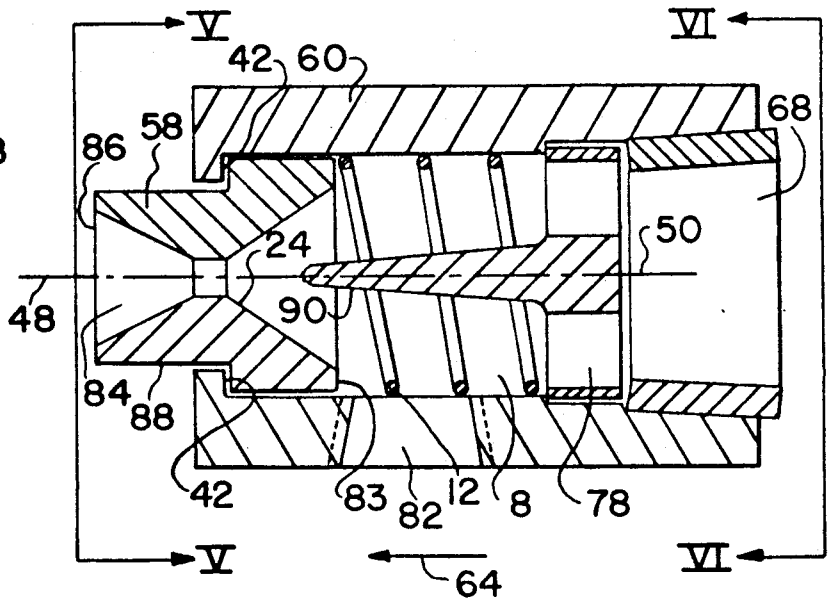
FIG. 4 is a side elevational view in section of a second embodiment of the nozzle assembly of the present invention.
Figure 5:
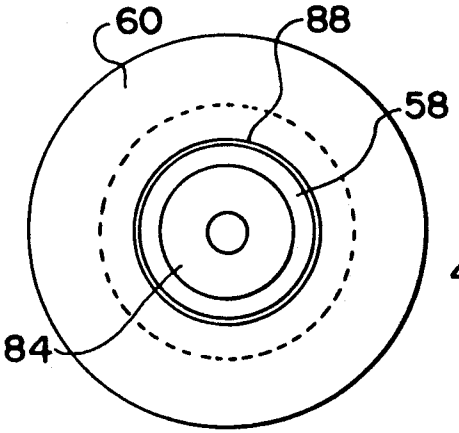
FIG. 5 is an elevational view of the nozzle assembly shown in FIG. 4 taken along line V—V of FIG. 4.

Now referring to FIGS. 4–6 there is illustrated another embodiment of the nozzle assembly in which like parts shown in FIGS. 1–3 are designated by like reference numbers shown in FIGS. 4–6. In this embodiment, nozzle 58 is biased relative to sleeve 60 by spring 62 in the direction of arrow 64. Thus, nozzle 58 is normally biased in an extended position rather than a retracted position. Nozzle 58 is similar to nozzle 6 although it has a slightly different configuration to provide a different fluid spray pattern from exit port 86 than from exit port 36 of nozzle 6. Nozzles 6 and 58 may be interchangeable.

In this embodiment of the invention, nozzle assembly 66 may employ pipe bushing 68 for the connection of nozzle assembly 66 to a source of fluid (not shown). Alternatively, nozzle assembly 66 may be provided with threads, such as threads 40 of nozzle assembly 2, for connecting to the fluid source. Both bushing 68 and threads 40, such as those shown in FIGS. 1–3 may be utilized in nozzle assembly 66.

Inlet ports 28, 30, 70 and 72 are provided in sleeve end 18 for transferring the fluid from the fluid source to interior cavity 8 of sleeve 60. Inlet ports 28, 30, 70 and 72 may be right circular cylinder openings as shown in FIG. 6, oblique circular cylinder openings as shown in FIG. 3 or some other desired configuration.

As an option, inlet port 82 in sleeve 60 is provided exclusively or in conjunction with inlet ports 28, 30, 70 and 72. If provided, inlet port 82 functions to allow fluid transfer from a fluid source (not shown) to interior cavity 8 of sleeve 60. An inlet port, such as inlet port 82, can also be utilized with the embodiment of the invention shown in FIGS. 1–3.

In operation, the nozzle assembly shown in FIGS. 4–6 is similar to that of the nozzle assembly shown in FIGS. 1–3. In the embodiment of the nozzle assembly shown in FIGS. 4–6, nozzle 58 is normally biased in its extended position by spring 12, as shown in FIG. 4. Nozzle 58 may or may not include surface 83 that applies a fluid force against nozzle 58 in the direction of arrow 64 in a manner similar to that as described with respect to surface 38 of FIG. 1. If such surface 83 is provided, then the fluid within interior cavity 80 may further bias nozzle 60 in the direction of its extended position.

In a manner similar to that as described in conjunction with the embodiment shown in FIGS. 1–3, fluid flow is directed from interior cavity 8, through interior opening 84 of nozzle 58 and out exit port 86. Should a clog in nozzle 58 occur, a force may then be applied to nozzle 58 in a direction opposite arrow 64 and move nozzle 58 it toward its retracted position. Plunger 90 would then enter interior opening 84 of nozzle 58 thereby clearing, or cleaning any foreign substance within nozzle 58.

Upon release of the force applied to nozzle 58, the biasing force of spring 62 and, if present, the fluid pressure within interior cavity 8, moves nozzle 58 toward its extended position in the direction of arrow 64, as shown in FIG. 4. The shape of plunger 90 differs from that of plunger 16 and may cooperate with nozzle 58 to produce a different spray pattern from exit port 86 than that produced from exit port 36.

Figure 9:
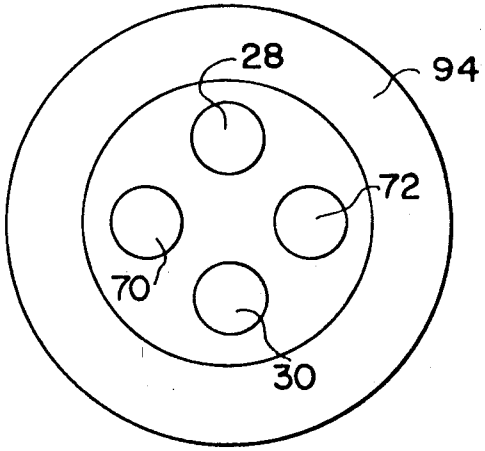
FIG. 9 is an elevational view of the nozzle assembly shown in FIG. 7 taken along line IX—IX of FIG. 7.
Figure 7:
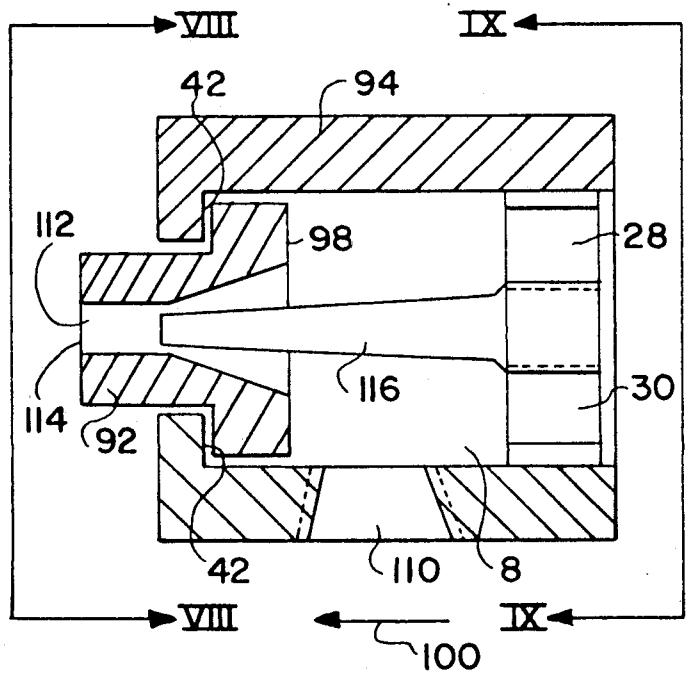
FIG. 7 is a side elevational view in section of a third embodiment of the nozzle assembly of the present invention.
Figure 8:
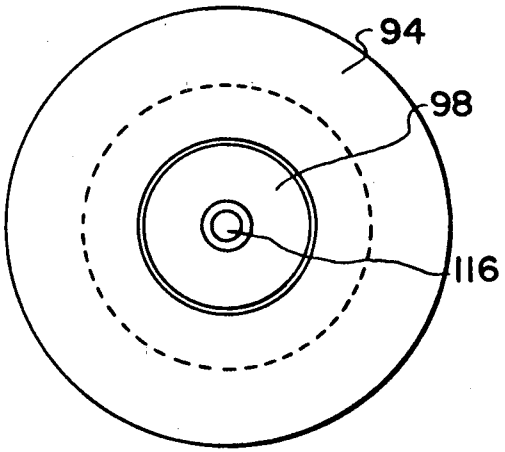
FIG. 8 is an elevational view of the nozzle assembly shown in FIG. 7 taken along line VIII—VIII of FIG. 7.

Now referring to FIGS. 7–9, there is illustrated another embodiment of the nozzle assembly in which like numerals of previously described figures designate like elements shown in FIGS. 4–6. However, with the embodiment shown in FIGS. 7–9, no biasing spring is provided to move nozzle 92 relative to sleeve 94. Nozzle 92 is of a slightly different configuration than previously described nozzles 58 and 6 and, therefore, may provide a different spray pattern from exit port 114 than produced from exit ports 36 and 86. However, nozzles 92, 58 and 6 are interchangeable. Also, plunger 116 is of a different configuration than plungers 16 and 90 and, therefore, also coacts with nozzle 92 to produce a different spray pattern from exit port 114 than produced from exit ports 36 and 86. However, plungers 16, 90 and 116 are interchangeable.

In the embodiment of the nozzle assembly shown in FIGS. 7-9, the fluid pressure within interior cavity 8 is applied to surface 98 of nozzle 92 thereby imparting a force in direction of arrow 100 toward the extended position of nozzle 92, as shown in FIG. 7. When no fluid pressure is present within interior cavity 8, nozzle 92 is slid to any position along its linear sliding path of travel relative to sleeve 94.

Fluid is introduced into interior cavity 96 through one or more of inlet ports 28, 30, 70, 72 and 110. Inlet ports 28, 30, 70 and 72 may be right circular cylinders, oblique circular cylinders or some other shape depending on the desired spray pattern from exit port 114 as discussed above. Inlet port 110, which is optional, may be provided exclusively, or in conjunction with inlet ports 28, 30, 70 and 72.

Once fluid is admitted into interior cavity 8 of sleeve 94, the fluid travels through interior opening 112 of nozzle 92 and out exit port 114. Should a clog in nozzle 92 occur, nozzle 92 is then slid in a direction opposite arrow 100 toward its retracted position thereby causing plunger 116 to enter interior opening 112 to thereby clear, or clean any foreign substance that may be clogging nozzle 92.

It is to be understood the various elements shown in each of the three embodiments may be interchanged among the other two embodiments in addition to that discussed herein. It may be appreciated, therefore, that the present invention provides an effective self-cleaning fluid nozzle that is useful in environments where foreign substances may have a tendency to clog the nozzle.

According to the provision of the patent statute, I have explained the principle, preferred construction and mode of operation of my invention and have illustrated and described what I now consider to represent its best embodiments. However, it should be understood that, within the scope of the appended claims, the invention may be protected otherwise than as specifically illustrated and described.

I claim:

1. A self-cleaning nozzle assembly for conducting a fluid comprising:

a sleeve having at least one fluid entry port for receiving the fluid, said sleeve defining a cavity for receiving the fluid from said fluid entry port, said sleeve having an extreme end displaced from said fluid entry port;

a nozzle having a body portion supported by said sleeve, said nozzle body portion having a fluid pressure surface with an opening therethrough and an exterior surface;

said nozzle slidable between a retracted position and an extending position within said sleeve cavity;

said nozzle exterior surface being held by and in slidable engagement with said extreme end of said sleeve;

said fluid pressure surface of said nozzle body portion receiving the fluid from said sleeve cavity to create a force on said fluid pressure surface to urge said nozzle body portion in the direction of said extended position, said nozzle opening receiving and conducting the fluid out of said nozzle body portion;

a plunger supported by said sleeve, said plunger having a body portion axially aligned with said nozzle body portion;

said nozzle body portion movable relative to said plunger body portion to position said plunger within said nozzle body portion opening when said nozzle is slid in a direction from said extended position toward said retracted position to clean said nozzle;

biasing means for biasing said nozzle body portion toward said retracted position; and balancing means for exerting a force on said nozzle body portion in a direction opposite to said force on said fluid pressure surface to generate a balancing effect on said nozzle.

2. A self-cleaning nozzle assembly as set forth in claim 1 wherein, said extreme end of said sleeve and said extractor surface of said nozzle form a seal to restrict passage of the fluid therebetween.

3. A nozzle assembly as set forth in claim 2, wherein, said nozzle opening defines at least a partial conical contour.

4. A nozzle assembly as set forth in claim 3, wherein, said plunger is movable longitudinally relative to said sleeve.

5. A nozzle assembly as set forth in claim 4, including, movable stop means for adjusting the distance said nozzle moves between said extended position and said retracted position.

6. A nozzle assembly as set forth in claim 5 wherein, said nozzle includes a fluid discharge port for conducting the fluid out of said nozzle body portion;

said plunger defines a contour;

said contour of said nozzle opening and said contour of said plunger cooperate to form a patterned spray of the fluid conducted out of said nozzle body portion; and said patterned spray is dependent on at least a selected one of the positions of said plunger relative to said nozzle body portion.

7. A nozzle assembly as set forth in claim 1 wherein, said fluid entry port is positioned at an end of said sleeve being distal to said extreme end of said sleeve.

8. A nozzle assembly as set forth in claim 7 including, said biasing means positioned between said nozzle body portion and said sleeve for biasing said nozzle body portion toward said retracted position.

9. A nozzle assembly as set forth in claim 8 wherein, said fluid entry port defines an oblique circular cylinder.

10. A nozzle assembly as set forth in claim 9 wherein, said biasing means includes compression spring means for biasing said nozzle in the direction of said retracted position.

11. A nozzle assembly as set forth in claim 1 wherein, said sleeve includes an end distal to said extreme end; and said fluid entry port is positioned between said extreme end and said distal end.

12. A nozzle assembly as set forth in claim 11 including, said biasing means positioned between said nozzle and said sleeve for biasing said nozzle toward said retracted position.

13. A nozzle assembly as set forth in claim 7 wherein, said balancing means includes said nozzle having a surface opposing said fluid pressure surface;

said nozzle body portion including a channel in fluid communication with said sleeve cavity and said opposing surface for application of fluid pressure from the fluid received by said sleeve cavity to create a force on said opposing surface to bias said nozzle body portion in the direction of said retracted position;

said fluid pressure surface defines an area;

said opposing surface defines an area; and the ratio of the force created by the fluid on said fluid pressure surface to the force created by the fluid on said opposing surface is proportional to the ratio of said area of said fluid pressure surface to said area of said opposing surface.

14. A method for cleaning a nozzle comprising the steps of:

conducting fluid to a nozzle sleeve;

positioning a nozzle for sliding engagement with an extreme end of the nozzle sleeve toward an extended position relative to the nozzle sleeve;

applying a spring force to the nozzle to normally maintain the nozzle in a retracted position relative to the nozzle sleeve;

transferring fluid from the nozzle sleeve to the nozzle while exerting a first fluid force upon the nozzle to urge the nozzle to the extended position;

conducting fluid away from the nozzle;

exerting a second fluid force and the spring force on the nozzle in a direction opposite to the direction of the first fluid force for moving the nozzle to the extended position to balance the fluid force applied to extend the nozzle from the nozzle sleeve; and sliding the nozzle in sliding engagement with the extreme end of the nozzle sleeve toward a retracted position relative to the sleeve to axially align and position a plunger within the nozzle to clean the nozzle.

15. A method as set forth in claim 14 which includes, sealing the nozzle to the extreme end of the nozzle sleeve to restrict passage of the fluid therebetween.

16. A method as set forth in claim 15 which includes, moving the plunger relative to the sleeve to adjust the pattern of the fluid conducted away from the nozzle.

17. A method as set forth in claim 16 which includes, limiting the distance of travel of the plunger from the extended position to the retracted position.

18. A self-cleaning nozzle assembly for conducting a fluid comprising:

a sleeve having a fluid entry port at an end of said sleeve, said fluid entry port receiving the fluid, said sleeve forming a cavity for receiving the fluid from said fluid entry port;

a nozzle having a body portion supported by said sleeve, said nozzle body portion having a fluid pressure surface for application of fluid pressure from the fluid received by said sleeve cavity to create a first force on said fluid pressure surface to bias said nozzle toward an extended position, said fluid pressure surface having an opening therethrough;

said nozzle being movable between a retracted position and said extended position within said sleeve cavity;

said nozzle opening receiving the fluid from said sleeve cavity and conducting the fluid out of said nozzle body portion;

a plunger supported by said sleeve, said plunger having a body portion;

said nozzle body portion movable relative to said plunger body portion to position said plunger within said nozzle body portion opening when said nozzle is moved in a direction from said extended position toward said retracted position to clean said nozzle;

means for applying a second force upon said nozzle body portion to determine the fluid pressure at which said nozzle moves from said extended position to said retracted position;

said means for applying a second force upon said nozzle body portion includes said nozzle having a surface opposing said fluid pressure surface;

said nozzle body portion including a channel in fluid communication with said sleeve cavity and said opposing surface for application of fluid pressure from the fluid received by said sleeve cavity to create said second force on said opposing surface to bias said nozzle body portion in the direction of said retracted position;

said fluid pressure surface defines an area;

said opposing surface defines an area;

the ratio of the first force created by the fluid on said fluid pressure surface to the second force created by the fluid on said opposing surface is proportional t the ratio of said area of said fluid pressure surface to said area of said opposing surface, and said fluid entry port including an oblique circular cylinder for creating a pattern of flow of the fluid conducted out of said nozzle body portion.

19. A nozzle assembly as set forth in claim 18 wherein, said plunger is movable longitudinally relative to said sleeve.

20. A nozzle assembly as set forth in claim 19 including, movable stop means for adjusting the distance said nozzle moves between said extended position and said retracted position.

* * * * *